US010429133B2

(12) United States Patent
Dziubinschi et al.

(10) Patent No.: US 10,429,133 B2
(45) Date of Patent: Oct. 1, 2019

(54) HEAT EXCHANGER ELEMENT WITH THERMAL EXPANSION FEATURE

(71) Applicant: Hanon Systems, Daejeon (KR)

(72) Inventors: Orest Alexandru Dziubinschi, Dearborn, MI (US); Kastriot Shaska, Northville, MI (US); Michael Sproule, Brighton, MI (US)

(73) Assignee: HANON SYSTEMS, Daejeon (KR)

( * ) Notice: Subject to any disclaimer, the term of this patent is extended or adjusted under 35 U.S.C. 154(b) by 74 days.

(21) Appl. No.: 15/228,050

(22) Filed: Aug. 4, 2016

(65) Prior Publication Data

US 2018/0038652 A1 Feb. 8, 2018

(51) Int. Cl.
*F28D 1/04* (2006.01)
*F28D 1/053* (2006.01)
(Continued)

(52) U.S. Cl.
CPC ..... *F28D 1/0443* (2013.01); *F28D 1/04* (2013.01); *F28D 1/0408* (2013.01);
(Continued)

(58) Field of Classification Search
CPC ..... F28D 1/0452; F28D 1/0443; F28F 9/02; F28F 9/06; F28F 9/002; F28F 9/013; F28F 2265/26
(Continued)

(56) References Cited

U.S. PATENT DOCUMENTS 5,954,123 A * 9/1999 Richardson ..... F28F 9/001 165/149
6,328,098 B1 * 12/2001 Kodumudi ..... F28F 9/001 165/149
(Continued)

FOREIGN PATENT DOCUMENTS

DE 102005011814 A1 * 9/2006 ..... B60K 11/085
DE 102005054711 A1 * 5/2007 ..... F01P 3/18
(Continued)

OTHER PUBLICATIONS

Stress and Strain—NDT Resource Center, NSF (2005).*

*Primary Examiner* — Cassey D Bauer
*Assistant Examiner* — Jenna M Hopkins
(74) *Attorney, Agent, or Firm* — Shumaker, Loop & Kendrick, LLP; James D. Miller

(57) ABSTRACT

A combination heat exchanger comprises a first heat exchanger assembly and a second heat exchanger assembly. The first heat exchanger assembly includes a first end tank, a second end tank, and a first heat exchanger core including a plurality of first heat exchanger tubes extending longitudinally in a first direction. The second heat exchanger assembly includes a third end tank, a fourth end tank, and a second heat exchanger core including a plurality of second heat exchanger tubes extending longitudinally in the first direction. A first coupling includes a first attachment portion rigidly coupled to the first end tank, a second attachment portion rigidly coupled to the third end tank, and a thermal
(Continued)

expansion portion extending between the first attachment portion and the second attachment portion. The first coupling allows for relative translation between the first end tank and the third end tank in the first direction.

12 Claims, 4 Drawing Sheets

(51) Int. Cl.

| | |
|---|---|
| ***F28F 9/02*** | (2006.01) |
| ***F28F 9/00*** | (2006.01) |
| ***F28F 9/06*** | (2006.01) |
| ***F28F 9/013*** | (2006.01) |
| ***F28F 9/26*** | (2006.01) |
| *F28D 21/00* | (2006.01) |

(52) U.S. Cl.
CPC ..... *F28D 1/0452* (2013.01); *F28D 1/05316* (2013.01); *F28F 9/001* (2013.01); *F28F 9/002* (2013.01); *F28F 9/013* (2013.01); *F28F 9/02* (2013.01); *F28F 9/0231* (2013.01); *F28F 9/06* (2013.01); *F28F 9/262* (2013.01); *F28D 2021/0054* (2013.01); *F28F 9/0243* (2013.01); *F28F 2220/00* (2013.01); *F28F 2265/26* (2013.01); *F28F 2275/04* (2013.01); *F28F 2275/085* (2013.01)

(58) Field of Classification Search
USPC ..... 165/81, 82, 83, 76, 176
See application file for complete search history.

(56) References Cited

U.S. PATENT DOCUMENTS

| | | | | |
|---|---|---|---|---|
| 7,360,584 | B2 * | 4/2008 | Hunzinger | F28D 1/0443 165/140 |
| 8,397,797 | B2 * | 3/2013 | Piggott | F28D 1/0426 165/140 |
| 8,844,306 | B2 * | 9/2014 | De La Cruz | F25B 40/00 62/285 |
| 9,551,274 | B2 * | 1/2017 | Eilemann | F02B 29/0412 |
| 9,677,826 | B2 * | 6/2017 | Hu | F28F 9/002 |
| 2002/0023735 | A1 * | 2/2002 | Uchikawa | F28D 1/0435 165/81 |
| 2002/0040776 | A1 * | 4/2002 | Kokubunji | F28D 1/0443 165/140 |
| 2003/0213587 | A1 * | 11/2003 | Mano | B60K 6/40 165/174 |
| 2004/0104574 | A1 * | 6/2004 | Nelson | B23K 20/08 285/329 |
| 2004/0250988 | A1 * | 12/2004 | Machanek | F28D 1/0443 165/76 |
| 2005/0006069 | A1 * | 1/2005 | Kamiyama | F28D 1/0443 165/140 |
| 2005/0102836 | A1 * | 5/2005 | Kroetsch | F28D 1/05366 29/890.054 |
| 2005/0133207 | A1 * | 6/2005 | Scoville | F28D 1/0443 165/140 |
| 2005/0217832 | A1 * | 10/2005 | Sanada | F28D 1/0452 165/140 |
| 2006/0102321 | A1 * | 5/2006 | Shincho | C01B 3/34 165/81 |
| 2006/0108101 | A1 * | 5/2006 | Hunzinger | F28D 1/0443 165/81 |
| 2006/0185824 | A1 * | 8/2006 | Harada | F28F 9/001 165/81 |
| 2007/0261820 | A1 * | 11/2007 | Rousseau | F28F 9/001 165/81 |
| 2008/0006390 | A1 * | 1/2008 | Nakayama | F28D 1/0443 165/76 |
| 2008/0006392 | A1 * | 1/2008 | Hayasaka | F01P 11/08 165/81 |
| 2008/0047689 | A1 * | 2/2008 | Hirose | F28D 1/05366 165/81 |
| 2008/0135208 | A1 * | 6/2008 | Horoho | F28F 9/001 165/67 |
| 2008/0169090 | A1 * | 7/2008 | Riondet | F28F 9/001 165/149 |
| 2008/0190596 | A1 * | 8/2008 | Bachner | F28F 9/001 165/149 |
| 2009/0078399 | A1 * | 3/2009 | Makita | F28D 1/0443 165/173 |
| 2010/0254081 | A1 * | 10/2010 | Koenig | F28D 1/05375 361/679.46 |
| 2011/0000642 | A1 * | 1/2011 | Hirose | F28D 1/05366 165/82 |
| 2011/0094257 | A1 * | 4/2011 | Rusignuolo | F28D 1/0443 62/498 |
| 2011/0240257 | A1 * | 10/2011 | Piggott | F28D 1/05366 165/67 |
| 2011/0240275 | A1 * | 10/2011 | Piggott | F28D 1/0426 165/173 |
| 2014/0202670 | A1 * | 7/2014 | Tylutki | F28F 9/001 165/149 |
| 2015/0176924 | A1 * | 6/2015 | Hu | F28F 9/002 165/67 |
| 2015/0247683 | A1 * | 9/2015 | Stockl | F28D 9/0062 165/76 |
| 2016/0146551 | A1 * | 5/2016 | Kolb | F28D 1/0417 165/173 |
| 2016/0201998 | A1 * | 7/2016 | Kennedy | F28F 9/001 165/81 |
| 2016/0238325 | A1 * | 8/2016 | Johnson | F25B 39/00 |
| 2016/0273838 | A1 * | 9/2016 | Pantow | F28F 9/0236 |
| 2016/0370127 | A1 * | 12/2016 | Okubo | F28F 21/084 |
| 2017/0307298 | A1 * | 10/2017 | Bronner | F28F 9/001 |
| 2017/0307301 | A1 * | 10/2017 | Sorensen | F28F 27/02 |

FOREIGN PATENT DOCUMENTS

| | | | | |
|---|---|---|---|---|
| DE | 102007011278 | A1 * | 9/2008 | F01P 3/18 |
| FR | 2925665 | A1 * | 6/2009 | F28D 1/0391 |
| JP | 3049386 | B2 * | 6/2000 | F28D 1/0408 |
| JP | 3399210 | B2 * | 4/2003 | F28D 1/0443 |
| JP | 3399210 | B2 * | 4/2003 | F28D 1/0443 |
| JP | WO 03106910 | A1 * | 12/2003 | F28D 1/0443 |
| JP | 2004116943 | A | 4/2004 | |
| JP | 2004340441 | A * | 12/2004 | F28D 1/0443 |
| JP | 2006145165 | A | 6/2006 | |
| JP | 2006226649 | A | 8/2006 | |
| JP | 2006234199 | A * | 9/2006 | F28F 9/001 |
| JP | 2008014622 | A * | 1/2008 | F28F 9/001 |
| JP | 2008014622 | A | 1/2008 | |
| JP | 4058825 | B2 * | 3/2008 | F28D 1/0408 |
| WO | WO-03106910 | A1 * | 12/2003 | F28D 1/0443 |
| WO | WO-2009062697 | A1 * | 5/2009 | F02B 29/0475 |
| WO | WO-2013031528 | A1 * | 3/2013 | F28F 9/002 |
| WO | WO-2013058242 | A1 * | 4/2013 | F28F 9/002 |

* cited by examiner

HEAT EXCHANGER ELEMENT WITH THERMAL EXPANSION FEATURE

FIELD OF THE INVENTION

The present disclosure relates to a coupling for a combination heat exchanger including at least two heat exchanger assemblies, and more specifically to a coupling having a thermal expansion feature for accommodating a varying degree of thermal expansion formed between the at least two heat exchanger assemblies.

BACKGROUND OF THE INVENTION

It is known to form a combination type heat exchanger wherein a common fluid is placed in heat exchange relationship with a pair of heat exchanger cores, each including a plurality of spaced apart heat exchanging tubes. In some instances, a single common inlet manifold tank and a single common outlet manifold tank are in fluid communication with each of the heat exchanger cores, while further including a baffle or other separating means within each of the manifold tanks to separate a first fluid associated with the first heat exchanger core from a second fluid associated with the second heat exchanger core. Such an arrangement advantageously allows for the common fluid to pass between the heat exchanging tubes of each respective heat exchanger core while exchanging heat with each of the first fluid and the second fluid simultaneously. A packaging size of the combination heat exchanger is thus minimized.

However, one issue associated with the use of a combination type heat exchanger arises when the first fluid and the second fluid have different temperatures, thereby causing each chamber formed in one of the common manifold tanks to be exposed to a different temperature than an adjacent chamber therein. This difference in temperature leads to varying degrees of thermal expansion occurring in each of the separated chambers. These varying degrees of thermal expansion can lead to failure when a portion of one of the manifold tanks expands or contracts relative to an adjacent portion of the same manifold tank, thereby causing a localized deformation of the manifold tank that can lead to failure thereof.

Accordingly, one solution to the problem of thermal expansion within the combination type heat exchanger is a complete or partial separation of each chamber of each of the manifold tanks into a separate manifold tank associated with only one of the respective heat exchanger cores. Each of the separate manifold tanks must then be coupled together to maintain a desired relationship therebetween. Such combination heat exchangers utilize mechanical attachment structures for coupling the separate manifold tanks, but the mechanical attachment structures add unnecessary weight, require additional and complicated manufacturing steps, and can lead to additional failure mechanisms between the coupled manifold tanks.

It is therefore desirable to provide a combination heat exchanger having a coupling with a thermal expansion accommodating feature to accommodate a thermal expansion between a pair of adjacent heat exchanger cores of the combination heat exchanger, wherein the coupling has a simplified structure that promotes an ease of manufacturing of the combination heat exchanger.

SUMMARY OF THE INVENTION

Consonant with the present disclosure, a combination heat exchanger including at least one coupling configured to accommodate a thermal expansion of a first heat exchanger core relative to a second heat exchanger core has surprisingly been discovered.

In one embodiment of the disclosure, a combination heat exchanger comprises a first heat exchanger assembly for receiving a first fluid, a second heat exchanger assembly for receiving a second fluid, and a first coupling. The first heat exchanger assembly includes a first end tank, a second end tank, and a first heat exchanger core extending between the first end tank and the second end tank and including a plurality of parallel extending first heat exchanger tubes extending longitudinally in a first direction. The second heat exchanger assembly includes a third end tank, a fourth end tank, and a second heat exchanger core extending between the third end tank and the fourth end tank and including a plurality of parallel extending second heat exchanger tubes extending longitudinally in the first direction. The first coupling includes a first attachment portion coupled to the first end tank, a second attachment portion coupled to the third end tank, and a thermal expansion portion between the first attachment portion and the second attachment portion. The thermal expansion portion is configured to allow for relative movement between the first end tank and the third end tank.

A method of manufacturing a combination heat exchanger is also disclosed. The method comprises the steps of providing a plurality of components of the combination heat exchanger, the plurality of components including a first end tank, a second end tank, a third end tank, a fourth end tank, a plurality of first heat exchanger tubes, a plurality of second heat exchanger tubes, and a first coupling including a first attachment portion, a second attachment portion, and a thermal expansion portion between the first attachment portion and the second attachment portion; locating the plurality of the components relative to each other, the locating including locating the first plurality of the first heat exchanger tubes between the first end tank and the second end tank, locating the plurality of the second heat exchanger tubes between the third end tank and the fourth end tank, locating first attachment portion adjacent the first end tank, and locating the second attachment portion adjacent the third end tank; and coupling the plurality of the components to each other in a single manufacturing process following the locating step, the coupling of the plurality of the components including coupling the plurality of the first heat exchanger tubes to each of the first end tank and the second end tank, coupling the plurality of the second heat exchanger tubes to each of the third end tank and the fourth end tank, coupling the first attachment portion to the first end tank, and coupling the second attachment portion to the third end tank.

BRIEF DESCRIPTION OF THE DRAWINGS

The above, as well as other advantages of the present disclosure, will become readily apparent to those skilled in the art from the following detailed description, particularly when considered in the light of the drawings described hereafter.

DETAILED DESCRIPTION OF THE INVENTION

The following detailed description and appended drawings describe and illustrate various exemplary embodiments of the invention. The description and drawings serve to enable one skilled in the art to make and use the invention, and are not intended to limit the present disclosure, application, or uses.

Figure 1:
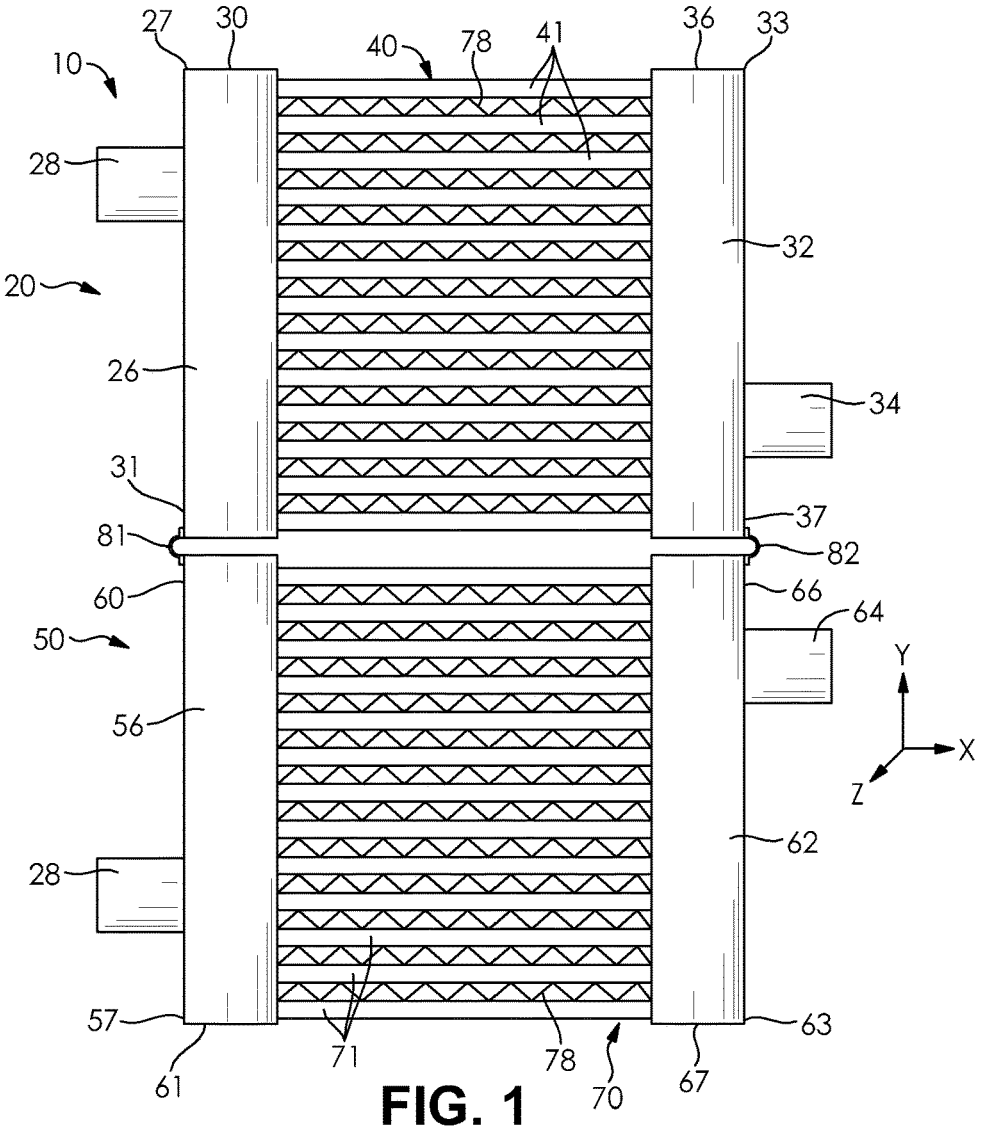
FIG. 1 is a side elevational view of a combination heat exchanger having a first coupling and a second coupling according to an embodiment of the invention.

FIG. 1 illustrates a combination heat exchanger 10 including a first heat exchanger assembly 20 and a second heat exchanger assembly 50. The first heat exchanger assembly 20 includes a first end tank 26 disposed at a first end 27 thereof and a second end tank 32 disposed at a second end 33 thereof. A first heat exchanger core 40 extends between the first end tank 26 and the second end tank 32. The second heat exchanger assembly 50 includes a third end tank 56 disposed at a first end 57 thereof and a fourth end tank 62 disposed at a second end 63 thereof. A second heat exchanger core 70 extends between the third end tank 56 and the fourth end tank 62. The end tanks 26, 32, 56, 62 act as manifold tanks for receiving or distributing a fluid to one of the first heat exchanger core 40 or the second heat exchanger core 70.

The combination heat exchanger 10 may be configured for use in a motor vehicle wherein different fluids are heated or cooled when used to perform various functions of the motor vehicle, including providing climate control to a passenger compartment of the motor vehicle or cooling components associated with a drive system of the motor vehicle, as non-limiting examples. Accordingly, the first heat exchanger assembly 20 may receive a first fluid therein while the second heat exchanger assembly 50 may receive a second fluid therein. In some applications, the first fluid and the second fluid are entirely independent fluids having substantially different compositions and properties. The first fluid and the second fluid may be associated with a common system of the motor vehicle or the first fluid and the second fluid may be associated with distinct systems of the motor vehicle. In other applications, a common fluid may be circulated through each of the first heat exchanger assembly 20 and the second heat exchanger assembly 50, but the common fluid may have different physical properties when encountering the first heat exchanger assembly 20 in comparison to the second heat exchanger assembly 50. For example, the common fluid may be a refrigerant for use in a heating ventilating and air conditioning (HVAC) system having a different temperature when encountering the first heat exchanger assembly 20 than when encountering the second heat exchanger assembly 50 due to a position of each of the first heat exchanger assembly 20 and the second heat exchanger assembly 50 relative to the remainder of the HVAC system. The combination heat exchanger 10 may also be used in other systems requiring the heating or cooling of fluids, as desired.

The first end tank 26 includes a first port 28 and the second end tank 32 includes a second port 34. The first port 28 may act as an inlet, an outlet, or a combination inlet/outlet of the first end tank 26 depending on an operating mode and configuration of the system including the first heat exchanger assembly 20. Similarly, the second port 34 may act as an inlet, an outlet, or a combination inlet/outlet of the second end tank 32 depending on an operating mode and configuration of the system including the first heat exchanger assembly 20. In some embodiments, one or both of the first end tank 26 and the second end tank 32 may include additional ports or other fluid couplings without departing from the scope of the present invention.

The first end tank 26 extends longitudinally from a first end 30 to a second end 31 thereof. In some embodiments, a portion of an outer surface of the first end tank 26 in facing relationship with the second end tank 32 includes a plurality of spaced apart openings (not shown) formed in an array extending in the longitudinal direction of the first end tank 26. In other embodiments, a side surface of the first end tank 26 in facing relationship with the second end tank 32 may include a header plate (not shown). The header plate may be a separate component coupled to a remainder of the first end tank 26 and may include a plurality of spaced apart openings (not shown) formed in an array extending in the longitudinal direction of the first end tank 26. If the header plate is used, the header plate may be coupled to the remainder of the first end tank 26 by any known method, including mechanical crimping and brazing. The first end tank 26 may have any suitable cross-sectional shape in a direction perpendicular to the longitudinal direction thereof. The first end tank 26 may accordingly have a substantially rectangular, trapezoidal, circular, elliptical cross-sectional shape, or other shape, as desired.

The second end tank 32 extends longitudinally from a first end 36 to a second end 37 thereof. In some embodiments, a portion of an outer surface of the second end tank 32 in facing relationship with the first end tank 26 includes a plurality of spaced apart openings (not shown) formed in an array extending in the longitudinal direction of the second end tank 32. In other embodiments, a side surface of the second end tank 32 in facing relationship with the first end tank 26 may include a header plate (not shown). The header plate may be a separate component coupled to a remainder of the second end tank 32 and may include a plurality of spaced apart openings (not shown) formed in an array extending in the longitudinal direction of the second end tank 32. If the header plate is used, the header plate may be coupled to the remainder of the second end tank 32 by any known method, including mechanical crimping and brazing.

The second end tank 32 may have any suitable cross-sectional shape in a direction perpendicular to the longitudinal direction thereof. The second end tank 32 may accordingly have a substantially rectangular, trapezoidal, circular, elliptical cross-sectional shape, or other shape, as desired.

The first heat exchanger core 40 includes a plurality spaced apart first heat exchanger tubes 41 arranged in parallel and extending from the first end tank 26 to the second end tank 32. Each of the first heat exchanger tubes 41 may be received in one of the openings of the first end tank 26 and one of the openings of the second end tank 32 to fluidly couple the first end tank 26 to the second end tank 32. The first heat exchanger tubes 41 accordingly extend in a direction substantially perpendicular to the longitudinal directions of each of the first end tank 26 and the second end tank 32.

The third end tank 56 includes a third port 58 and the fourth end tank 62 includes a fourth port 64. The third port 58 may act as an inlet, an outlet, or a combination inlet/outlet of the third end tank 56 depending on an operating mode and configuration of the system including the third end tank 56. Similarly, the fourth port 64 may act as an inlet, an outlet, or a combination inlet/outlet of the fourth end tank 62 depending on the operating mode and configuration of the system including the fourth end tank 62. In some embodiments, one or both of the third end tank 56 and the fourth end tank 62 may include additional ports or other fluid couplings without departing from the scope of the present invention.

The third end tank 56 extends longitudinally from a first end 60 to a second end 61 thereof. In some embodiments, a portion of an outer surface of the third end tank 56 in facing relationship with the fourth end tank 62 includes a plurality of spaced apart openings (not shown) formed in an array extending in the longitudinal direction of the third end tank 56. In other embodiments, a side surface of the third end tank 56 in facing relationship with the fourth end tank 62 may include a header plate (not shown). The header plate may be a separate component coupled to a remainder of the third end tank 56 and may include a plurality of spaced apart openings (not shown) formed in an array extending in the longitudinal direction of the third end tank 56. If the header plate is used, the header plate may be coupled to the remainder of the third end tank 56 by any known method, including mechanical crimping and brazing. The third end tank 56 may have any suitable cross-sectional shape in a direction perpendicular to the longitudinal direction thereof. The third end tank 56 may accordingly have a substantially rectangular, trapezoidal, circular, elliptical cross-sectional shape, or other shape, as desired.

The fourth end tank 62 extends longitudinally from a first end 66 to a second end 67 thereof. In some embodiments, a portion of an outer surface of the fourth end tank 62 in facing relationship with the third end tank 56 includes a plurality of spaced apart openings (not shown) formed in an array extending in the longitudinal direction of the fourth end tank 62. In other embodiments, a side surface of the fourth end tank 62 in facing relationship with the third end tank 56 may include a header plate (not shown). The header plate may be a separate component coupled to a remainder of the fourth end tank 62 and may include a plurality of spaced apart openings (not shown) formed in an array extending in the longitudinal direction of the fourth end tank 62. If the header plate is used, the header plate may be coupled to the remainder of the fourth end tank 62 by any known method, including mechanical crimping and brazing. The fourth end tank 62 may have any suitable cross-sectional shape in a direction perpendicular to the longitudinal direction thereof. The fourth end tank 62 may accordingly have a substantially rectangular, trapezoidal, circular, elliptical cross-sectional shape, or other shape, as desired.

The second heat exchanger core 70 includes a plurality of spaced apart second heat exchanger tubes 71 arranged in parallel and extending from the third end tank 56 to the fourth end tank 62. Each of the second heat exchanger tubes 71 may be received in one of the openings of the third end tank 56 and one of the openings of the fourth end tank 62 to fluidly couple the third end tank 56 to the fourth end tank 62. The second heat exchanger tubes 71 accordingly extend in a direction substantially perpendicular to the longitudinal directions of each of the third end tank 56 and the fourth end tank 62.

The first end tank 26 is arranged substantially parallel to and in substantial alignment with the third end tank 56, while the second end tank 32 is arranged substantially parallel to and in substantial alignment with the fourth end tank 62. The first end tank 26 and the second end tank 32 may have substantially the same length in the longitudinal direction and the third end tank 56 and the fourth end tank 62 may have substantially the same length in the longitudinal direction. The first end tank 26 and the second end tank 32 may have the same length or a different length in comparison to the third end tank 56 and the fourth end tank 62, as desired. The first end tank 26 may have the same cross-sectional shape and size as the third end tank 56 and the second end tank 56 may have the same cross-sectional shape and size as the fourth end tank 62, as desired. Alternatively, the first end tank 26 may have a different cross-sectional shape and size from the third end tank 56 and the second end tank 56 may have a different cross-sectional shape and size from the fourth end tank 62, as desired.

The first end tank 26 and the third end tank 32 may be formed in a common manufacturing process wherein the first end tank 26 and the third end tank 56 are formed as an integral unit that is later separated into two or more distinct tanks. Similarly, the second end tank 32 and the fourth end tank 62 may be formed in a common manufacturing process wherein the second end tank 32 and the fourth end tank 62 are formed as an integral unit that is later separated into two or more distinct tanks. For example, each of the end tanks 26, 32, 56, 62 may include one or more internal walls or baffles extending in a direction perpendicular to the longitudinal direction of each of the end tanks 26, 32, 56, 62 that are capable of being divided into end pieces of each of the separately formed end tanks. In other embodiments, the first end tank 26, the second end tank 32, the third end tank 56, and the fourth end tank 62 are each formed in a separate manufacturing process, as desired.

In the embodiment shown, the first heat exchanger core 40 and the second heat exchanger core 70 are arranged substantially co-planar to each other resulting in the first heat exchanger tubes 41 and the second heat exchanger tubes 71 being arranged in parallel and formed in a columnar array. Each of the first heat exchanger tubes 41 may have the same length as each of the second heat exchanger tubes 71 to cause a spacing formed between the first end tank 26 and the second end tank 32 to be substantially equal to a spacing formed between the third end tank 56 and the fourth end tank 62. A surface area increasing feature such as a fin structure 78 may be disposed between each pair of adjacent first heat exchanger tubes 41 or each pair of adjacent second heat exchanger tubes 71. In some instances, the surface area increasing feature may also extend between an outermost one of the first heat exchanger tubes 41 and an outermost one of the second heat exchanger tubes 71 (not shown).

The first end tank 26 is coupled to the third end tank 56 by a first coupling 81 and the second end tank 32 is coupled to the fourth end tank 62 by a second coupling 82. As described hereinabove, the first heat exchanger core 40 receives a first fluid and the second heat exchanger core 70 receives a second fluid. The first fluid and the second fluid may be the same fluid or different fluids, depending on an application of the combination heat exchanger 10. In many instances, a temperature difference exists between the first fluid and the second fluid during normal operation of the combination heat exchanger 10. The heat exchanger core conveying the fluid with the higher temperature will accordingly undergo a greater degree of thermal expansion than the heat exchanger core conveying the fluid with the lower temperature. In some embodiments, the first heat exchanger core 40 and the second heat exchanger core 70 are formed from a common material. For example, the first heat exchanger core 40 and the second heat exchanger core 70 may each be formed from aluminum, as a non-limiting example. Other suitable materials for forming the combination heat exchanger 10 may be used, as desired, without departing from the scope of the present invention. Accordingly, the first coupling 81 and the second coupling 82 are each configured to accommodate a thermal expansion of the first heat exchanger core 40 relative to the second heat exchanger core 70, and more specifically a thermal expansion of the plurality of the first heat exchanger tubes 41 relative to a thermal expansion of the plurality of the second heat exchanger tubes 71. In other embodiments, the the first heat exchanger core 40 and the second heat exchanger core 70 are formed from different materials.

The first heat exchanger tubes 41 and the second heat exchanger tubes 71 extend longitudinally in a first direction X. The first end tank 26, the second end tank 32, the third end tank 56, and the fourth end tank 62 extend longitudinally in a second direction Y arranged perpendicular to the first direction X. A third direction Z extends perpendicular to each of the first direction X and the second direction Y.

The thermal expansion of the first heat exchanger core 40 relative to the second heat exchanger core 70 is especially problematic when the expansion occurs generally in the first direction X. For example, if the second heat exchanger tubes 71 of the second heat exchanger core 70 are caused to thermally expand relative to the first heat exchanger tubes 41 of the first heat exchanger core 40 due to the introduction of the second fluid therein, the greatest degree of expansion will occur in the first direction X since this is the longitudinal direction of each of the second heat exchanger tubes 71. The expansion in the first direction X causes the spacing between the first end tank 26 and the second end tank 32 to differ from the spacing between the third end tank 56 and the fourth end tank 62. Accordingly, the first coupling 81 and the second coupling 82 must accommodate the varying degrees of thermal expansion between the first heat exchanger core 40 and the second heat exchanger core 70.

In the embodiment shown, the first coupling 81 and the second coupling 82 are symmetrically arranged with respect to the first heat exchanger assembly 20 and the second heat exchanger assembly 50 and have substantially identical structure. As such, a description hereinafter of the structure and features of the first coupling 81 will also describe the second coupling 82.

Figure 2:
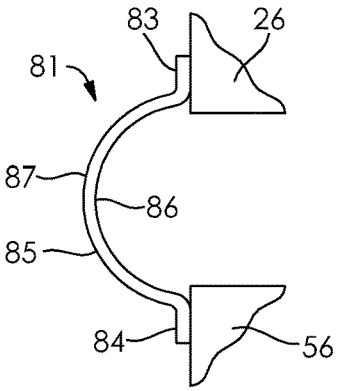
FIG. 2 is a fragmentary side elevational view of the first coupling of FIG. 1.

FIG. 2 illustrates an embodiment of the first coupling 81. The first coupling 81 includes a first attachment portion 83, a second attachment portion 84, and a thermal expansion portion 85. The first attachment portion 83 is configured to be rigidly coupled to the first end tank 26. The second attachment portion 84 is configured to be rigidly coupled to the third end tank 56. The thermal expansion portion 85 is configured to provide a connection between the first attachment portion 83 and the second attachment portion 84 which accommodates relative movement between the first attachment portion 83 and the second attachment portion 84 in the first direction X when the first coupling 81 is coupled to each of the first end tank 26 and the third end tank 56.

The first attachment portion 83 may be coupled to the first end tank 26 by any known method including welding and brazing, as non-limiting examples. Similarly, the second attachment portion 84 may be coupled to the third end tank 56 by any known method including welding and brazing, as non-limiting examples. As shown in FIG. 1, the first coupling 81 may be coupled to a side surface of each of the first end tank 26 and the third end tank 56. However, as explained hereinafter, the first coupling 81 may alternatively be coupled to an end surface of at least one of the first end tank 26 and the third end tank 56, as desired, without departing from the scope of the present invention.

Figure 3:
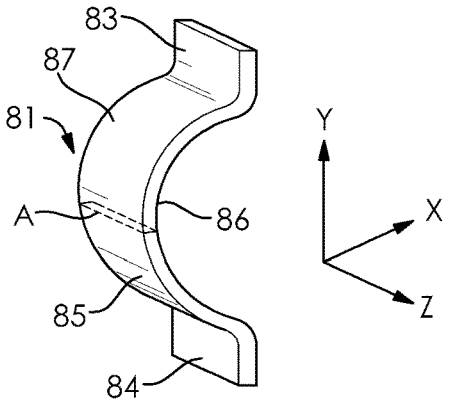
FIG. 3 is a perspective view of the first coupling of FIGS. 1 and 2.

In the embodiment shown, the thermal expansion portion 85 is substantially arcuate in shape including a concave surface 86 in facing relationship with each of the first end tank 26 and the third end tank 56 and a convex surface 87 formed opposite the concave surface 86. However, the thermal expansion portion can have other shapes, as desired. A thickness of the thermal expansion portion 85 is measured as a distance between the concave surface 86 and the convex surface 87 in a direction extending perpendicular thereto for any given position along a length of the thermal expansion portion 85. Accordingly, as shown in FIG. 3, the thickness of the thermal expansion portion 85 extends in at least one of the first direction X and the third direction Y for any given position along the length of the thermal expansion portion 85. The thickness is measured primarily in the first direction X along a central region of the thermal expansion portion 85. In contrast, the thickness is measured primarily in the second direction Y along each end region of the thermal expansion portion 85.

In some embodiments, the thickness of the thermal expansion portion 85 is substantially constant along the length thereof. In other embodiments, the thickness of the thermal expansion feature 85 may vary along a length thereof, as desired. The first attachment portion 83 and the second attachment portion 84 may have substantially the same thickness as the thermal expansion portion 85. However, in some embodiments a thickness of each of the first attachment portion 83 and the second attachment portion 84 may be different from the thickness of the thermal expansion portion 85, as desired.

The thermal expansion portion 85 further includes a width extending perpendicular to the thickness and measured in the third direction Z. The width of the thermal expansion portion 85 may be substantially constant along a length of the first coupling 81, including the first attachment portion 83, the second attachment portion 84, and the thermal expansion portion 85. In other embodiments, the width of the thermal expansion portion 85 may vary from at least one of the first attachment portion 83 and the second attachment portion 84, as desired.

Relative thermal expansion between one of the first heat exchanger core 40 and the second heat exchanger core 70 will result in a force extending primarily in the first direction X applied to one of the first attachment portion 83 and the second attachment portion 84 when the first coupling 81 is rigidly attached to each of the first end tank 26 and the third end tank 56. As explained hereinabove, the thermal expansion of one of the first heat exchanger core 40 and the second heat exchanger core 70 relative to each other results in at least one of the first coupling 81 and the second coupling 82 experiencing a stress and potentially deforming at least partially in the first direction X to avoid potential failure of one of the first coupling 81 and the second coupling 82.

Additionally, during operation of the combination heat exchanger 10, a vibration of the combination heat exchanger 10 in the third direction Z is transferred between the first heat exchanger assembly 20 and the second heat exchanger assembly 50 via the first coupling 81 and the second coupling 82. Accordingly, with specific reference to the first coupling 81, at least one of the first attachment portion 83 and the second attachment portion 84 will experience a repeated force caused by the vibration acting primarily along the third direction Z. The repeated force acting in the third direction Z could lead to a failure of the first coupling 81 if the application of the repeated force causes a deformation of at least a portion of the first coupling 81 in the third direction Z. Accordingly, it is beneficial to avoid deformation of the first coupling 81 in the third direction Z by creating a stiffness of the first coupling 81 which accommodates the force and the vibration acting in the third direction Z.

Figure 4:
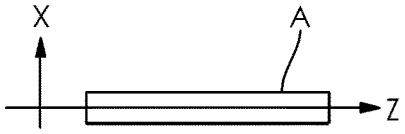
FIG. 4 is a schematic view illustrating an arrangement of a cross-section of the first coupling of FIGS. 1-3 relative to a first bending moment acting on the cross-section.
Figure 5:
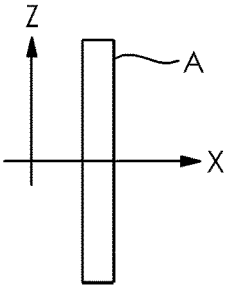
FIG. 5 is a schematic view illustrating an arrangement of the cross-section of the first coupling of FIGS. 1-3 relative to a second bending moment acting on the cross-section.

FIGS. 4 and 5 illustrate a cross-section A of the thermal expansion portion 85 at a central point of the thermal expansion portion 85, wherein the cross-section extends in each of the first direction X and the third direction Z. The cross-section A includes the thickness extending entirely in the first direction X and the width extending entirely in the third direction Z. With reference to FIG. 4, the application of the force to one of the first attachment portion 83 or the second attachment portion 84 in the first direction X results in a bending moment formed within the first coupling 81 at the cross-section A about a centroidal axis extending through a center of area of the cross-section A in the third direction Z. With reference to FIG. 5, the application of the vibrational force acting in the third direction Z results in a bending moment formed within the first coupling 81 at the cross-section A about a centroidal axis extending through a center of area of the cross-section A in the first direction X. An area moment of inertia for a given cross-section describes a capacity for the given cross-section to resist bending with respect a reference axis. The area moment of inertia for the given cross-section is increased when the area occupied by the cross-section in question is disposed at an increased distance from the associated reference axis. As can be seen by comparing FIG. 4 to FIG. 5, the cross-section A has a greater area moment of inertia when subjected to the moment about the centroidal axis extending in the first direction X (FIG. 5) than when subjected to the moment about the centroidal axis extending in the third direction Z (FIG. 4) due to the longitudinal direction of the cross-section extending in the third direction Z.

This relationship beneficially allows the thermal expansion portion 85 to flex and deform more easily in response to a bending moment formed about a reference axis extending in the third direction Z when subjected to a force in the first direction X than when responding to a bending moment formed about a reference axis extending in the first direction X when subjected to a force in the third direction Z.

Accordingly, as a general principle, the width of the thermal expansion portion 85 for any given point along a length of the thermal expansion portion 85 is greater than the thickness thereof for any given point along a length thereof. Stated otherwise, a minimum width of the thermal expansion portion 85 is always greater than a maximum thickness thereof. Alternatively, the width dimension of the thermal expansion portion 85 is greater than a distance formed between the concave surface 86 and the convex surface 87 when measured exclusively in the first direction X.

The arcuate shape of the thermal expansion portion 85 allows the first coupling 81 to distribute a stress therein without failing when subjected to a force acting on one of the first attachment portion 83 and the second attachment portion 84 in the first direction X. However, the first coupling 81 may have any profile, so long as the first coupling 81 maintains the desired relationship between the bending stiffness of the first coupling 81 in the first direction X and the bending stiffness of the first coupling 81 in the third direction Z.

In use, the first heat exchanger assembly 20 circulates the first fluid through the first end tank 26, the second end tank 32, and the first heat exchanger core 40 while the second heat exchanger assembly 50 circulates the second fluid through the third end tank 56, the fourth end tank 62, and the second heat exchanger core 70. A third fluid is caused to flow through each of the first heat exchanger core 40 and the second heat exchanger core 70 to exchange heat with each of the first fluid and the second fluid. If, for example, the second fluid has a greater temperature than the first fluid, the second heat exchanger core 70 will thermally expand in the first direction X relative to the first heat exchanger core 40. The expansion of the second heat exchanger core 70 causes an outwardly extending force to be applied to each of the first coupling 81 and the second coupling 82 in a direction parallel to the first direction X. The defined relationship between the thickness dimension, the width dimension, and the geometry of each of the first coupling 81 and the second coupling 82 allows for the first coupling 81 and the second coupling 82 to undergo stress and, if necessary, a limited degree of deformation, without either of the first coupling 81 or the second coupling 82 failing.

In some circumstances, if the thermal expansion of the second heat exchanger core 70 relative to the first heat exchanger core 40 is great enough, each of the first coupling 81 and the second coupling 82 will undergo at least some deformation to allow the third end tank 56 to be spaced apart from the fourth end tank 62 by a greater distance than the first end tank 26 is spaced apart from the second end tank 32. The arcuate shape of each of the first coupling 81 and the second coupling 82 allows the stresses that arise during the deformation thereof to be distributed more equally throughout each of the first coupling 81 and the second coupling 82, thereby allowing for a suitable amount of deformation without a risk of failure.

Additionally, the defined relationship of the thickness dimension, the width dimension, and the geometry of the first coupling 81 and the second coupling 82 also allows for the first coupling 81 and the second coupling 82 to resist deformation when subjected to a vibration acting in the third direction Z due to the increased bending stiffness in this direction, thereby preventing failure due to repeated cycles of vibration in the third direction Z.

Figure 6:
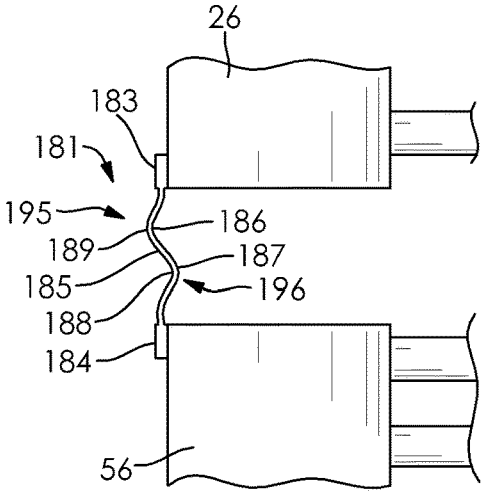
FIG. 6 is a fragmentary side elevational view of a coupling for attachment to a side surface of an end tank of the combination heat exchanger with the coupling including a plurality of arcuate portions according to another embodiment of the invention.

FIG. 6 illustrates a first coupling 181 according to another embodiment of the invention. The first coupling 181 includes a defined relationship between a thickness and a width thereof in similar fashion to the first coupling 81 in order to provide a desired degree of bending stiffness in each of the first direction X and the third direction Z. The first coupling 181 is substantially similar in structure to the first coupling 81 illustrated in FIGS. 2 and 3 except the first coupling 181 has a different profile in comparison to the first coupling 81. The first coupling 181 includes a first attachment portion 183 configured to be rigidly coupled to a side surface of the first end tank 26, a second attachment portion 184 configured to be rigidly coupled to a side surface of the third end tank 56, and a thermal expansion portion 185 extending between the first attachment portion 183 and the second attachment portion 184. The thermal expansion portion 185 includes both a first concave surface 186 and a first convex surface 187 forming one side thereof and a second concave surface 188 and a second convex surface 189 forming an opposing side thereof. As such, the thermal expansion portion 185 includes a first arcuate portion 195 and an oppositely arranged second arcuate portion 196. Although only two arcuate portions 195, 196 are illustrated, it should be understood that additional arcuate portions (not shown) may be utilized in an alternating pattern without departing from the scope of the present invention. The arcuate portions 195, 196 beneficially cause a stress formed in the thermal expansion portion 185 to be distributed between the arcuate portions 195, 196 to prevent failure thereof during deformation of the thermal expansion portion 185.

It should be understood that the first coupling 181 is preferably utilized in combination with a second coupling (not shown) for coupling the second end tank 32 and the fourth end tank 62, wherein the second coupling has identical structure to the first coupling 181 with a symmetric arrangement. The second coupling similarly includes a first attachment portion (not shown) that may be rigidly coupled to the second end tank 32 by any known method, including welding and brazing, as non-limiting examples, as well as a second attachment portion (not shown) that may be rigidly coupled to the fourth end tank 62 by any known method, including welding and brazing, as non-limiting examples.

Figure 7:
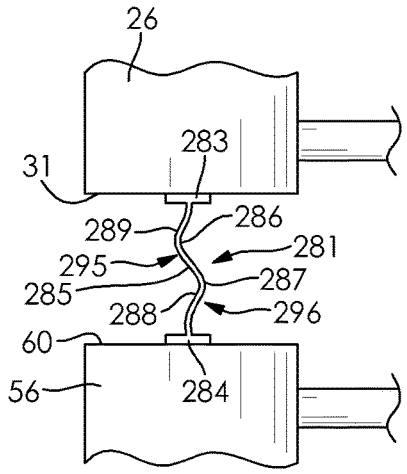
FIG. 7 is a fragmentary side elevational view of a coupling for attachment to an end surface of an end tank of the combination heat exchanger including a plurality of arcuate portions according to another embodiment of the invention.

FIG. 7 illustrates a first coupling 281 according to another embodiment of the invention. The first coupling 281 includes a defined relationship between a thickness and a width thereof in similar fashion to the first coupling 81 in order to provide a desired degree of bending stiffness in each of the first direction X and the third direction Z. The first coupling 281 is substantially similar in structure to the first coupling 181 illustrated in FIG. 6 except the first coupling 281 has a different profile in comparison to the first coupling 181. The first coupling 281 includes a first attachment portion 283 configured to be rigidly coupled to the first end tank 26, a second attachment portion 284 configured to be rigidly coupled to the third end tank 56, and a thermal expansion portion 285 extending between the first attachment portion 283 and the second attachment portion 284. In contrast to the arrangement of the first coupling 181 illustrated in FIG. 6, the first coupling 281 includes a thermal expansion portion 285 that is arranged substantially transverse to each of the first attachment portion 283 and the second attachment portion 284. This arrangement allows for the first attachment portion 283 to be coupled directly to the second end 31 of the first end tank 26 and for the second attachment portion 284 to be coupled directly to the first end 60 of the third end tank 56.

The thermal expansion portion 285 includes both a first concave surface 286 and a first convex surface 287 forming one side thereof and a second concave surface 288 and a second convex surface 289 forming an opposing side thereof. As such, the thermal expansion portion 285 includes a first arcuate portion 295 and an oppositely arranged second arcuate portion 296. Although only two arcuate portions 295, 296 are illustrated, it should be understood that additional arcuate portions (not shown) may be utilized in an alternating pattern without departing from the scope of the present invention. The arcuate portions 295, 296 beneficially cause a stress formed in the thermal expansion portion 285 to be distributed between the arcuate portions 295, 296 to prevent failure thereof during deformation of the thermal expansion portion 285.

Although a single first coupling 281 is shown in FIG. 7, in other embodiments a plurality of the first couplings 281 extend between the second end 31 of the first end tank 26 and the first end 60 of the third end tank 56. The number of first couplings 281 may be selected based on a desired stiffness of the plurality of the first couplings 281 in each of the first direction X and the third direction Z.

It should be understood that the first coupling 281 is preferably utilized in combination with a second coupling (not shown) for coupling the second end tank 32 and the fourth end tank 62, wherein the second coupling has identical structure to the first coupling 281 with a symmetric arrangement. The second coupling similarly includes a first attachment portion (not shown) that may be rigidly coupled to the second end tank 32 by any known method, including welding and brazing, as non-limiting examples, as well as a second attachment portion (not shown) that may be rigidly coupled to the fourth end tank 62 by any known method, including welding and brazing, as non-limiting examples. Additionally, the second end tank 32 and the fourth end tank 62 may be coupled to each other by a plurality of the second couplings, as desired.

Figure 8:
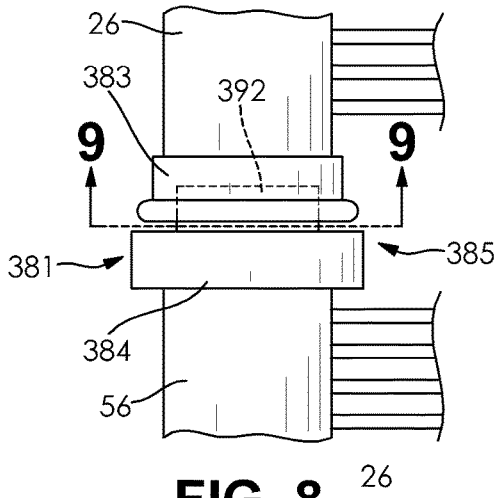
FIG. 8 is a fragmentary side elevational view of a coupling including a mechanical attachment feature according to another embodiment of the invention.
Figure 9:
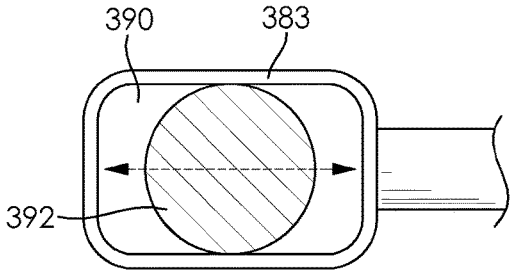
FIG. 9 is a fragmentary cross-sectional view of the coupling of FIG. 8 taken along line 9-9.

FIGS. 8 and 9 illustrate a first coupling 381 according to another embodiment of the invention. The first coupling 381 differs from the first couplings 81, 181, 281 shown in FIGS. 2, 6, and 7 in that the first coupling 381 utilizes a translatable mechanical connection. The first coupling 381 includes a first attachment portion 383 configured to be rigidly coupled to the first end tank 26, a second attachment portion 384 configured to be rigidly coupled to the third end tank 56, and a thermal expansion portion 385 for slidably coupling the first attachment portion 383 to the second attachment portion 384.

The first attachment portion 383 and the second attachment portion 384 may be coupled to each respective end tank 26, 56 by any known method, including welding and brazing, as desired. In other embodiments, each of the first attachment portion 383 and the second attachment portion 384 may include an opening (not shown) formed in an end thereof having an inner surface substantially corresponding in shape to an outer surface of an end of a respective end tank 26, 56, causing each of the first attachment portion 383 and the second attachment portion 384 to act as a sleeve received over an end of one of the end tanks 26, 56. The first attachment portion 383 and the second attachment portion 384 may additionally be further secured to one of the end tanks 26, 56 by an additional mechanical connection, as desired.

The thermal expansion portion 385 includes an opening 390 formed in the first attachment portion 383 cooperating with a projection 392 extending from the second attachment portion 384. The opening 390 has a length extending in the first direction X, a depth extending in the second direction Y, and a width extending in the third direction Z. The projection 392 extends from the second attachment portion 384 toward the first attachment portion 383 in the second direction Y. The projection 392 includes a width extending in the third dimension Z and a length extending in the first direction X. The projection 392 may be substantially cylindrical in shape, as desired, but other shapes may be used without departing from the scope of the present invention.

The opening 390 is configured to receive the projection 392 therein to slidably couple the first attachment portion 383 to the second attachment portion 384. As shown in FIG. 9, the length of the opening 390 is greater than a length of the projection 392, thereby allowing the second attachment portion 384 to translate relative to the first attachment portion 383 in the first direction X to accommodate for a relative thermal expansion between the first heat exchanger core 40 and the second heat exchanger core 70. Additionally, the width of the projection 392 is substantially equal to the width of the opening 390. Accordingly, the first attachment portion 383 is constrained relative to the second attachment portion 384 in the third direction Z when the projection 392 is received in the opening 390, thereby aiding in properly transferring vibrations formed in the combination heat exchanger 10 between the first end tank 26 and the second end tank 56.

The projection 392 may be dimensioned to allow the projection 392 to be press-fit into the opening 390. The press-fit connection allows the projection 392 to be retained within the opening 390 due to frictional forces formed between the projection 392 and an inner surface of the first attachment portion 383 defining the opening 390. However, the friction formed between projection 392 and the opening 390 must be low enough to allow for suitable relative movement between the projection 392 and the opening 390 when subjected to a load in the first direction X. In other embodiments, the projection 392 is maintained in the opening 390 by an additional structural feature, as desired. For example, a track-like feature may be formed within the opening 390 configured to cooperate with a corresponding feature of the projection 392 to further constrain movement of the projection 392 within the opening 390, such as constraining motion of the projection 392 relative to the opening 390 in the second direction Y.

The first coupling 381 is shown as coupling a first end tank 26 and a third end tank 56 having identical widths in the first direction X, but it should be understood that the first coupling 381 may be used to couple two adjacent end tanks having different cross-sectional shapes and sizes so long as each of the first attachment portion 383 and the second attachment portion 384 are shaped and dimensioned to cooperate with each respective end tank 26, 56.

It should be understood that the first coupling 381 is preferably utilized in combination with a second coupling (not shown) for coupling the second end tank 32 and the fourth end tank 62, wherein the second coupling has identical structure to the first coupling 381. The second coupling similarly includes a first attachment portion (not shown) that may be rigidly coupled to the second end tank 32 by any known method, including welding and brazing, as non-limiting examples, as well as a second attachment portion (not shown) that may be rigidly coupled to the fourth end tank 62 by any known method, including welding and brazing, as non-limiting examples. Additionally, the second end tank 32 and the fourth end tank 62 may be coupled to each other by a plurality of the second couplings, as desired.

Figure 10:
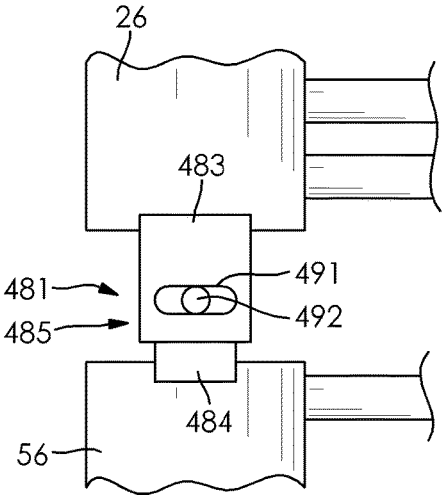
FIG. 10 is a fragmentary side elevational view of a coupling including a mechanical attachment feature according to another embodiment of the invention.
Figure 11:
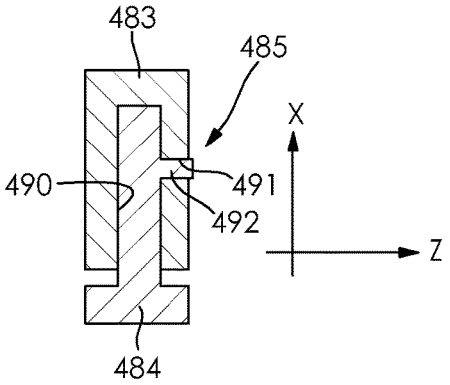
FIG. 11 is a cross-sectional elevational view of the coupling of FIG. 10 taken along line 11-11.

FIGS. 10 and 11 illustrate a first coupling 481 according to another embodiment of the invention. The first coupling 481 includes a first attachment portion 483 configured to be rigidly coupled to the first end tank 26 and a second attachment portion 484 configured to be rigidly coupled to the third end tank 56. The first attachment portion 483 includes an opening 490 and a slot 491 formed therein. The opening 490 is dimensioned to receive at least a portion of the second attachment portion 484 therein. The slot 491 extends from the opening 490 and is elongated in the first direction X. The second attachment portion 484 includes a projection 492 extending in a direction perpendicular to a longitudinal direction of the slot 491. The projection 492 extends into the slot 491 when the at least a portion of the second attachment feature 484 is received in the opening 490 of the first attachment feature 483. The slot 491 and the projection 492 cooperate to form a thermal expansion portion 485 of the first coupling 481. The projection 492 is slidably disposed in the slot 491 and capable of translation in the first direction X when a movement of the first end tank 26 relative to the third end tank 56 occurs in the first direction X, such as when the first heat exchanger core 40 and the second heat exchanger core 70 undergo different degrees of thermal expansion. In some instances, the projection 492 may be a bearing or other component configured to rotate relative to a central axis thereof to allow for reduced frictional forces when the projection 492 translates along the slot 491. In other instances, the projection 492 is closely fit to the slot 491 and has a sliding contact within the slot 491.

As shown in FIG. 11, a movement of the first attachment portion 483 relative to the second attachment portion 484 may be constrained in at least one of the second direction Y and the third direction Z due to the close fitting relationship between the at least a portion of the second attachment portion 484 and the opening 490 and the slot 491 of the first attachment portion 483. This close-fitting relationship aids in preventing failure of the first coupling 481 in response to vibrational forces acting in one of the second direction Y and the third direction Z.

The first coupling 481 is illustrated FIG. 10 as being coupled to a side surface of each of the first end tank 26 and the third end tank 56, but it should be understood that the first coupling may be coupled to each of the second end 31 of the first end tank 26 and the first end 60 of the third end tank 56 without departing from the scope of the present invention.

It should be understood that the first coupling 481 is preferably utilized in combination with a second coupling (not shown) for coupling the second end tank 32 and the fourth end tank 62, wherein the second coupling has identical structure to the first coupling 481. The second coupling similarly includes a first attachment portion (not shown) that may be rigidly coupled to the second end tank 32 by any known method, including welding and brazing, as non-limiting examples, as well as a second attachment portion (not shown) that may be rigidly coupled to the fourth end tank 62 by any known method, including welding and brazing, as non-limiting examples.

Each of the previously described first couplings 81, 181, 281, 381, 481 (and each of the associated symmetrically arranged second couplings) has been described as including a first attachment portion and a second attachment portions that are each directly rigidly coupled to an associated end tank by a method such as welding or brazing. However, each of the couplings 81, 181, 281, 381, 481 may alternatively be coupled to an associated end tank by a mechanical attachment feature.

Figure 12:
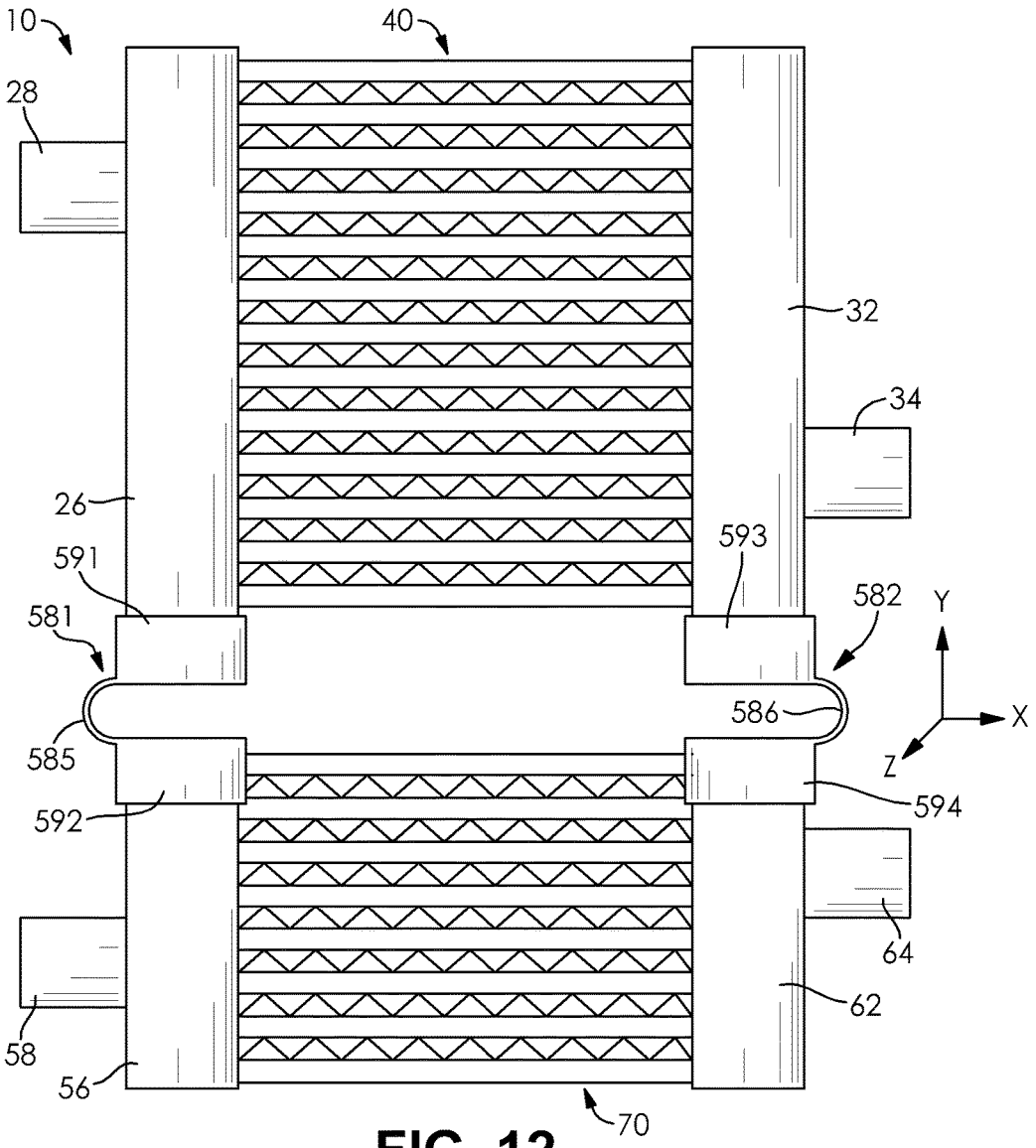
FIG. 12 is a side elevational view of a combination heat exchanger including a first coupling and a second coupling according to another embodiment of the invention.

FIG. 12 illustrates the combination heat exchanger 10 as including a first coupling 581 and a second coupling 582 according to another embodiment of the invention. The first coupling 581 includes a first mechanical attachment element 591 coupled to the first end tank 26 and acting as a first attachment portion, a second mechanical attachment element 592 coupled to the third end tank 56 and acting as a second attachment portion, and a first thermal expansion portion 585 extending between the first mechanical attachment element 591 and the second mechanical attachment element 592. The second coupling 582 includes a third mechanical attachment element 593 coupled to the second end tank 32 and acting as a first attachment portion, a fourth mechanical attachment portion 594 coupled to the fourth end tank 62 and acting as a second attachment portion, and a second thermal expansion portion 586 extending between the third mechanical attachment element 593 and the fourth mechanical attachment element 594. Each of the mechanical attachment elements 591, 592, 593, 594 forms a sleeve including an inner surface having a shape substantially corresponding to a shape of an outer surface of one of the end tanks 26, 32, 56, 62.

The first thermal expansion portion 585 has substantially the same structure as the thermal expansion portion 85 illustrated in FIGS. 2 and 3, including a defined relationship between a thickness and a width thereof. The second thermal expansion portion 586 has substantially the same structure and effect as the first thermal expansion portion 585, but the second thermal expansion portion 586 is oppositely and symmetrically arranged relative thereto.

As shown in FIG. 12, the first thermal expansion portion 585 may be integrally formed with the first mechanical attachment element 591 and the second mechanical attachment element 592 and the second thermal expansion portion 586 may be integrally formed with the third mechanical attachment element 593 and the fourth mechanical attachment element 594. Alternatively, each of the first thermal expansion portion 585 and the second thermal expansion portion 586 may be separately formed relative to each of the mechanical attachment elements 591, 592, 593, 594 before later being rigidly coupled thereto by any known method, including welding, brazing, or an additional form of mechanical attachment, as desired.

Although the mechanical attachment elements 591, 592, 593, 594 are shown exclusively in combination with arcuate thermal expansion portions resembling the thermal expansion portion 85 illustrated in FIGS. 2 and 3, it should be understood that any of the previously described couplings 181, 281, 381, 481 may be adapted for use with any of the mechanical attachment elements 591, 592, 593, 594 by substituting an associated mechanical attachment portion with one of the mechanical attachment elements 591, 592, 593, 594 as shown in FIG. 12.

Although each of the first couplings 81, 181, 281, 381, 481, 581 are described as being suitable for use with a symmetrically arranged second coupling having identical structure, it should also be understood that each of the first couplings 81, 181, 281, 381, 481, 581 may also be utilized opposite a substantially rigid connection formed between the third end tank 32 and the fourth end tank 62 without departing from the scope of the present invention. However, the use of a single first coupling 81, 181, 281, 381, 481, 581 may cause the stress experienced by the single first coupling 81, 181, 281, 381, 481, 581 to be increased in comparison to a first coupling 81, 181, 281, 381, 481, 581 that cooperates with an associated second coupling, hence such an arrangement is only suitable for circumstances where the relative thermal expansion experienced between the first heat exchanger core 40 and the second heat exchanger core 70 is not great enough to cause the first coupling 81, 181, 281, 381, 481, 581 to fail as a result of the stress generated therein during deformation thereof.

The couplings have been described as being rigidly coupled to the associated end tanks by any known method. However, it is increasingly common for combination heat exchangers to utilize end tanks and heat exchanger cores that are coupled to each other using a brazing method. Accordingly, a manufacturing process for forming the combination heat exchanger may advantageously include each of the couplings being rigidly coupled to the associated end tanks by a similar brazing technique, thereby allowing for each of the relevant components to be joined in a single brazing and curing process.

For example, with reference to the embodiment of FIG. 1, a method of manufacturing the combination heat exchanger 10 may include a step of providing the first end tank 26, the second end tank 32, the third end tank 56, the fourth end tank 62, the plurality of the first heat exchanger tubes 41, the plurality of the second heat exchanger tubes 71, the first coupling 81, and the second coupling 82. Each of the components forming the combination heat exchanger 10 may be formed from a common material, such as aluminum. Next, the method includes a step of locating the plurality of the first heat exchanger tubes 41 adjacent the openings formed in each of the first end tank 26 and the second end tank 32, locating the plurality of the second heat exchanger tubes 71 adjacent the openings formed in each of the third end tank 56 and the fourth end tank 62, locating the first attachment portion 83 of the first coupling 81 adjacent the first end tank 26, locating the second attachment portion 84 of the first coupling 81 adjacent the third end tank 56, locating the first attachment portion of the second coupling 82 adjacent the second end tank 32, and locating the second attachment portion of the second coupling 82 adjacent the fourth end tank 62.

Once all components are properly located, the method includes an additional step of coupling the plurality of the first heat exchanger tubes 41 to each of the first end tank 26 and the second end tank 32, coupling the plurality of the second heat exchanger tubes 71 to each of the third end tank 56 and the fourth end tank 62, coupling the first coupling 81 to each of the first end tank 26 and the third end tank 56, and coupling the second coupling 82 to each of the second end tank 32 and the fourth end tank 62. The coupling step may be performed using any known method of brazing and may occur in a single manufacturing process following completion of the locating step. As a non-limiting example, the brazing method may be a furnace brazing method wherein a filler material is located at each joint formed between the components in need of coupling prior to the assembly being cured by a furnace or other similar device. Alternatively, other forms of brazing may be employed without departing from the scope of the present invention.

Alternatively, a method of manufacturing the combination heat exchanger 10 may include providing a common first end tank (not shown) having a first internal separator or baffle (not shown) and a common second end tank (not shown) having a second internal separator or baffle (not shown), wherein each separator or baffle represents a separation of each respective end tank into distinct chambers acting as individual end tanks. For example, the common first end tank may include a separator or baffle separating a portion thereof to become the first end tank 26 from a portion thereof to become the third end tank 56 and the common second end tank may include a separator or baffle separating a portion thereof to become the second end tank 32 from a portion thereof to become the fourth end tank 62. Next, the plurality of the first heat exchanger tubes 41 and the plurality of the second heat exchanger tubes 71 are located relative to each respective portion of the common first end tank and the common second end tank. Next, the first coupling 81 is located to bridge the separator or baffle formed between the portion to become the first end tank 26 and the portion to become the third end tank 56 while the second coupling 82 is located to bridge the separator or baffle formed between the portion to become the second end tank 32 and the portion to become the fourth end tank 62.

Once all components are properly located, the components may be joined to each other in a single manufacturing process using a known method such as brazing. The brazing method may be a furnace brazing method, as desired. Once all components are coupled to each other, the common first end tank is cut or otherwise separated at the separator or baffle formed therein to separate the first end tank 26 from the third end tank 56 and the common second end tank is cut or otherwise separated at the separator or baffle formed therein to separate the second end tank 32 from the fourth end tank 62. This method of manufacturing the combination heat exchanger 10 advantageously allows for each of the common first end tank and the common second end tank to be formed in a single manufacturing process before later being separated.

Alternatively, the heat exchanger cores and the couplings may be coupled to the end tanks in separate manufacturing processes, as desired. For example, if a mechanical attachment method is used, the mechanical attachment of the couplings to the associated end tanks may be performed following a manufacturing of the remainder of the combination heat exchanger 10, as desired.

The combination heat exchanger 10 is shown and described as including a first heat exchanger assembly 20 coupled to a second heat exchanger assembly 50, but it should be understood that the combination heat exchanger 10 may also include additional heat exchanger assemblies coupled thereto. Each additional heat exchanger assembly may be coupled to the combination heat exchanger 10 using any of the aforementioned couplings 81, 181, 281, 381, 481, 581 without departing from the scope of the present invention.

While certain representative embodiments and details have been shown for purposes of illustrating the invention, it will be apparent to those skilled in the art that various changes may be made without departing from the scope of the disclosure, which is further described in the following appended claims.

What is claimed is:

1. A combination heat exchanger comprising:

a first heat exchanger assembly receiving a first fluid, the first heat exchanger assembly including a first end tank, a second end tank, and a first heat exchanger core extending between the first end tank and the second end tank and including a plurality of first heat exchanger tubes extending therebetween longitudinally in a first direction;

a second heat exchanger assembly receiving a second fluid, the second heat exchanger assembly including a third end tank, a fourth end tank, and a second heat exchanger core extending between the third end tank and the fourth end tank and including a plurality of second heat exchanger tubes extending therebetween longitudinally in the first direction, wherein the first end tank, the second end tank, the third end tank, and the fourth end tank extend longitudinally in a second direction perpendicular to the first direction, the first end tank and the third end tank aligned longitudinally in the second direction and the second end tank and the fourth end tank aligned longitudinally in the second direction, wherein the first heat exchanger core and the second heat exchanger core are arranged co-planar on a plane defined by the first direction and the second direction; and a first coupling including a first attachment portion coupled to the first end tank, a second attachment portion coupled to the third end tank, and a thermal expansion portion extending between the first attachment portion and the second attachment portion, wherein the first attachment portion and the second attachment portion are spaced from each other in the second direction, wherein the thermal expansion portion is arcuate in shape and curves around an axis extending in a third direction arranged perpendicular to the first direction and the second direction as the thermal expansion portion extends from the first attachment portion to the second attachment portion, wherein the thermal expansion portion permits relative movement between the first end tank and the third end tank during operation of the combination heat exchanger.

2. The combination heat exchanger according to claim 1, wherein the relative movement between the first end tank and the third end tank occurs in the first direction.

3. The combination heat exchanger according to claim 2, wherein the thermal expansion portion of the first coupling has a greater resistance to deformation when subjected to a force acting on one of the first attachment portion or the second attachment portion in the third direction than when subjected to a force acting on one of the first attachment portion or the second attachment portion in the first direction.

4. The combination heat exchanger according to claim 2, wherein the thermal expansion portion of the first coupling has a width in the third direction and a thickness in at least one of the first direction and the second direction, wherein the width of the thermal expansion portion is greater than the thickness of the thermal expansion portion along a length thereof.

5. The combination heat exchanger according to claim 2, wherein the thermal expansion portion of the first coupling has a width in the third direction, wherein the width of the thermal expansion portion is greater than a distance measured between two opposing side surfaces of the thermal expansion portion in the first direction for an entirety of the thermal expansion portion.

6. The combination heat exchanger according to claim 2, wherein the thermal expansion portion of the first coupling has a first resistance to deformation in response to a bending moment formed about an axis extending in the third direction and a second resistance to deformation in response to a bending moment formed about an axis extending in the first direction, wherein the second resistance to deformation is greater than the first resistance to deformation.

7. The combination heat exchanger according to claim 1, wherein the thermal expansion portion of the first coupling includes a plurality of alternating and oppositely arranged arcuate portions.

8. The combination heat exchanger according to claim 1, further comprising a second coupling for coupling the second end tank to the fourth end tank.

9. The combination heat exchanger according to claim 8, wherein the second coupling includes a first attachment portion coupled to the second end tank, a second attachment portion coupled to the fourth end tank, and a thermal expansion portion between the first attachment portion of the second coupling and the second attachment portion of the second coupling, wherein the second coupling permits relative movement between the second end tank and the fourth end tank.

10. The combination heat exchanger according to claim 1, wherein the first attachment portion of the first coupling is rigidly coupled to the first end tank by brazing and the second attachment portion of the first coupling is rigidly coupled to the third end tank by brazing.

11. A method of manufacturing a combination heat exchanger, the method comprising the steps of:

providing a plurality of components of the combination heat exchanger, the plurality of components including a first end tank, a second end tank, a third end tank, a fourth end tank, a plurality of first heat exchanger tubes, a plurality of second heat exchanger tubes, and a first coupling including a first attachment portion, a second attachment portion, and a thermal expansion portion extending between the first attachment portion and the second attachment portion;

locating the plurality of the components relative to each other, the locating including locating the first plurality of the first heat exchanger tubes to extend in a first direction between the first end tank and the second end tank, locating the plurality of the second heat exchanger tubes to extend in the first direction between the third end tank and the fourth end tank, locating the first end tank, the second end tank, the third end tank, and the fourth end tank to extend longitudinally in a second direction perpendicular to the first direction with the first end tank and the third end tank aligned longitudinally in the second direction and the second end tank and the fourth end tank aligned longitudinally in the second direction, locating the first attachment portion adjacent the first end tank, and locating the second attachment portion adjacent the third end tank, wherein the plurality of first heat exchanger tubes and the plurality of second heat exchangers are located to be arranged co-planar on a plane defined by the first direction and the second direction; and coupling the plurality of the components to each other in a single manufacturing process following the locating step, the coupling of the plurality of the components including coupling the plurality of the first heat exchanger tubes to each of the first end tank and the second end tank, coupling the plurality of the second heat exchanger tubes to each of the third end tank and the fourth end tank, coupling the first attachment portion to the first end tank, and coupling the second attachment portion to the third end tank;

wherein following the coupling step the first attachment portion and the second attachment portion are spaced from each other in the second direction while the thermal expansion portion is arcuate in shape and curves around an axis extending in a third direction arranged perpendicular to the first direction and the second direction as the thermal expansion portion extends from the first attachment portion to the second attachment portion.

12. The method according to claim 11, wherein the single manufacturing process is a brazing process.

* * * * *